United States Patent [19]

Hubbard, Sr.

[11] Patent Number: 4,480,339

[45] Date of Patent: Nov. 6, 1984

[54] VARIABLY EXTENSIBLE WAISTBAND STRUCTURE

[76] Inventor: John S. Hubbard, Sr., 826 Knollwood La., Bremen, Ga. 30110

[21] Appl. No.: 444,849

[22] Filed: Nov. 26, 1982

[51] Int. Cl.[3] ..... A41F 9/02

[52] U.S. Cl. ..... 2/237

[58] Field of Search ..... 2/237, 221, 236, 220, 2/76

[56] References Cited

U.S. PATENT DOCUMENTS

| | | | |
|---|---|---|---|
| 2,195,894 | 4/1940 | Moore | 2/237 |
| 2,277,227 | 3/1942 | Hardie | 2/237 |
| 2,745,107 | 5/1956 | Gemignani | 2/236 |
| 2,757,381 | 8/1956 | Le Cottier et al. | 2/237 |
| 3,129,434 | 4/1964 | Weemhoff | 2/236 |
| 3,221,346 | 12/1965 | Johnson et al. | 2/236 |
| 3,422,461 | 1/1969 | Froehlich | 2/236 |
| 3,427,661 | 2/1969 | Navasky | 2/236 |
| 3,559,213 | 2/1971 | Goodman | 2/237 |
| 3,663,963 | 5/1972 | Miller | 2/237 |
| 3,723,993 | 4/1973 | Ruby | 2/237 |
| 3,800,332 | 4/1974 | Forrest | 2/237 |
| 3,869,728 | 3/1975 | Spencer | 2/221 |
| 4,193,136 | 3/1980 | Pierce | 2/237 |
| 4,332,034 | 6/1982 | Muse | 2/237 |

FOREIGN PATENT DOCUMENTS

| | | | |
|---|---|---|---|
| 1122640 | 5/1956 | France | 2/237 |
| 1249526 | 11/1960 | France | 2/237 |
| 1268724 | 6/1961 | France | 2/237 |

*Primary Examiner*—H. Hampton Hunter

*Attorney, Agent, or Firm*—Kilpatrick & Cody

[57] ABSTRACT

A garment waistband comprising an elastic band as well as a fabric web which is attached to the gdhmet body dnd to the elastic band and which covers segments of the upper portion of, and restrains the elongation of, the elastic band. The fabric web does not cover the area of the elastic band near the side seams of the gdrment, however; in this area, the elastic band stretches more easily than in areas covered by the fabric web. This waistband thus allows the garment to fit snugly and resists rolling, yet provides an extra degree of extensibility for comfort and allows a proper fit even where the wearer has experienced weight losses or gains.

11 Claims, 8 Drawing Figures

VARIABLY EXTENSIBLE WAISTBAND STRUCTURE

BACKGROUND OF THE INVENTION

This invention relates to a garment waistband which employs an elastic band and a four-segment fabric web.

Waistbands employing elastic structures are well-known in the prior art. Such waistbands characteristically are intended to provide a snug, comfortable fit while eliminating the need for a belt. A problem experienced with such waistbands, however, is that their upper portions tend to roll outwardly over themselves, especially when worn by individuals with significant body fat in their waist and pelvic regions. This rolling tendency has been addressed by several designs.

One design for garment waistbands aimed at offering greater resistance to rolling employs an elastic band having a cross-section which is concave on its inner surface. The top portion, being of smaller circumference around the wearer than the lower portions, naturally resists rolling down and over those portions. Such a waistband can result in discomfort, however, if its top edges press too strongly into the waist of the wearer.

Another roll-resistant waistband employs a two-part elastic band. The upper part, typically comprising a significant portion of the cross-section of the waistband, is uniformly less extensible than the lower portion. In this manner, the upper portion of the waistband, whose vertical width is insufficient to allow rolling, but great enough not to cut into the wearer, fits the garment snugly to the wearer, while the lower portion acts as a skirt, conforming to the body of the wearer for a comfortable fit. Even the fairly wide upper portion of this type of waistband can cause discomfort, however, where the garment fits too snugly, where the wearer has experienced a temporary weight gain, or where the garment is worn for a long period of time.

Other efforts directed at alleviating the rolling problem include placing semi-rigid stays in the waistband structure and weaving the waistband material with stiff vertical fibers. However, the rigidity inherent in such designs results in discomfort to the wearer, particularly when the garment employing such a waistband is worn for long periods of time.

SUMMARY OF THE INVENTION

The waistband of the present invention employs an elastic band and a fabric web which offers greater resistance to elongation than the elastic band and which is attached to segments of the upper inside surface and outer middle surface of the elastic band. The fabric web is omitted, however, in the areas near the side seams of the garment employing the waistband. The segments of the upper portion of the elastic band to which the fabric web is attached are partially constrained from elongation by the fabric web, while the areas of the elastic band not attached to the fabric web are free to stretch. As a result, the waistband of the present invention offers resistance to rolling in the areas where such resistance is needed, but allows stretching for comfort at the wearer's sides.

It is therefore an object of the present invention to provide a garment waistband which eliminates the need for a belt and which is comfortable to the wearer but which resists rolling of the waistband over the outer portion of the garment.

It is a further object of the present invention to provide a garment waistband which is comfortable to the wearer but which fits the wearer sufficiently snugly to support the garment on the wearer's body, even in cases when he or she has experienced weight gain or loss which might otherwise cause discomfort or a poor fit.

It is another object of the present invention to provide a garment waistband, portions of which provide greater resistance to elongation and the remainder of which, particularly near the area at the side seams of the garment, offers less resistance to elongation.

Yet a further object of the present invention is to provide a garment waistband which is attractive in appearance, reveals outwardly a minimum of visible stitching, and is relatively simple to manufacture.

Still another object of the present invention is to provide an attractive garment waistband in which the portions of the elastic band that are exposed have colored stripes or other pleasing designs.

Other objects and advantages of the present invention will become apparent during the course of the following description.

DETAILED DESCRIPTION OF THE DRAWINGS

Figure 1:
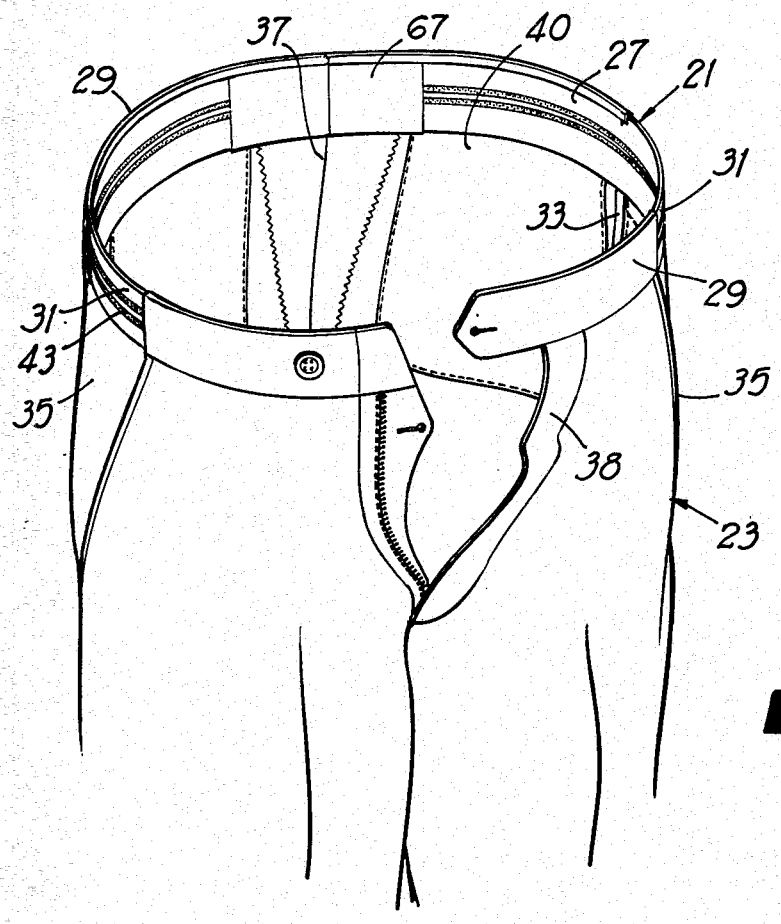
FIG. 1 is a perspective view of the upper portion of a garment employing a waistband of the present invention.

FIG. 1 shows the arrangement of the waistband 21 of the present invention in relation to a garment 23 in which it is employed. Waistband 21 is generally located in the top portion of garment 23. It comprises an elastic band 27 and a fabric web 29 covering portions of elastic band 27. Other portions of the outer surface of elastic band 27, however, are not covered by or attached to fabric web 29; these non-web areas 31 of elastic band 27 which are located near the side seams 33 of garment body 35, are apparent on the outside of garment 23 when it is worn. These outwardly exposed non-web areas 31 of elastic band 27 are visible in FIGS. 1 and 2. Garment 23 may be any type of garment which is at least partially suspended or supported from the body trunk, including trousers, skirts or athletic wear, and in the depicted embodiment, garment body 35 includes a seat seam 37, a fly 38 and pockets 40.

Elastic band 27 is of an elastic material such as nylon polymer, and may be of uniform elasticity; alternatively, it may comprise upper material more resistant to elongation, and lower material less resistant to elongation, such as is disclosed in earlier art. Elastic band 27 may be a single continuous piece of elastic material, or it may comprise left and right elastic band members which are independent pieces of elastic material, separated from one another in garment 23 by seat seam 37 and, if appropriate, other material forming waistband 21. In either event, the left and right portions of elastic band 27 shall be distinguished from each other herein by reference to left and right "sections" of elastic band 27. In the depicted embodiment, elastic band 27 is decorated on its inner and outer surfaces with colored stripes 43, but it may be manufactured in non-decorated form or have other colorful or fanciful designs, on one or both surfaces.

Figure 2:
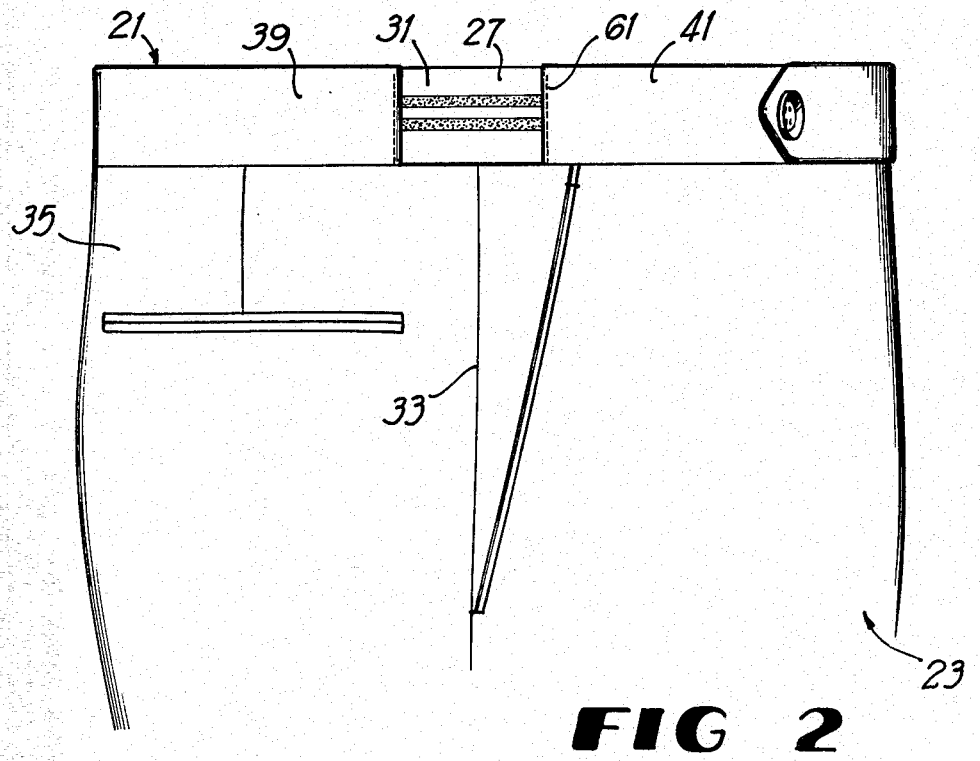
FIG. 2 is a side elevational view of the right side of the garment of FIG. 1.

Fabric web 29, which partially covers elastic band 27, comprises four segments, two for each section of elastic band 27: right rear fabric web segment 39 and right front fabric web segment 41 can be seen in FIG. 2. The rear fabric web segments extend from the outlet 67 near the seat seam area of waistband 21 to non-web areas 31. The front fabric web segments extend from non-web areas 31 to the fly or front area of garment 23. These four segments of fabric web 29 may be of the same material as garment body 35, or they may be of material having color and/or stretching properties different from the material of garment body 35. Fabric web 29 thus may have no appreciable extensibility, or it may be partially extensible, or it may have great elasticity. In any event, the fabric web segments should offer greater resistance to stretching than elastic band 27 to which they are attached.

Figure 3:
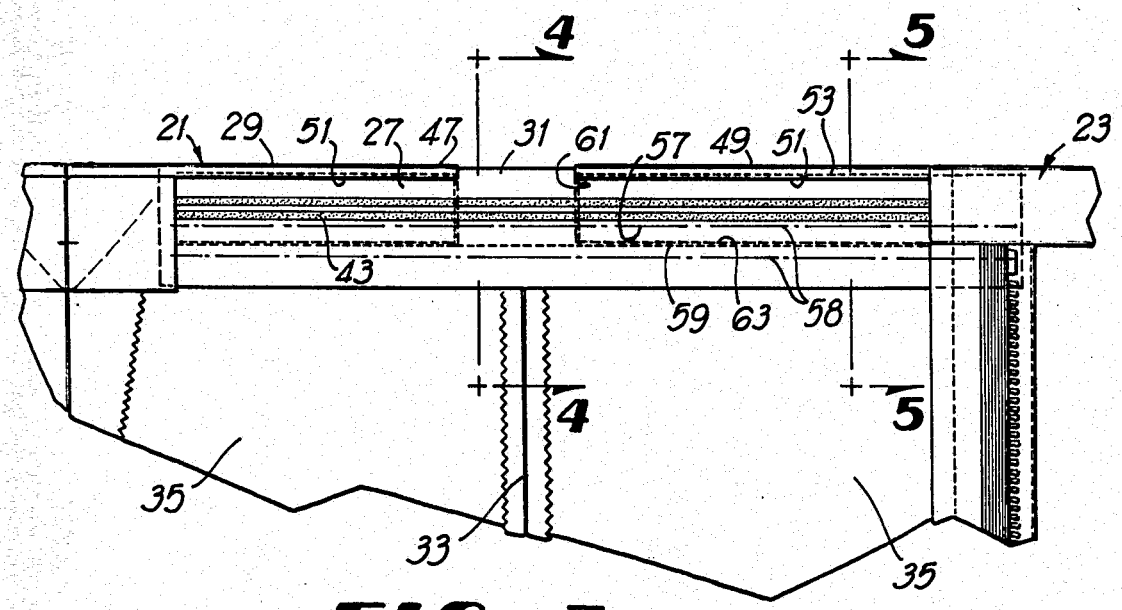
FIG. 3 is a schematic side elevational view of part of the inside surface of the garment of FIG. 1.
Figure 6:
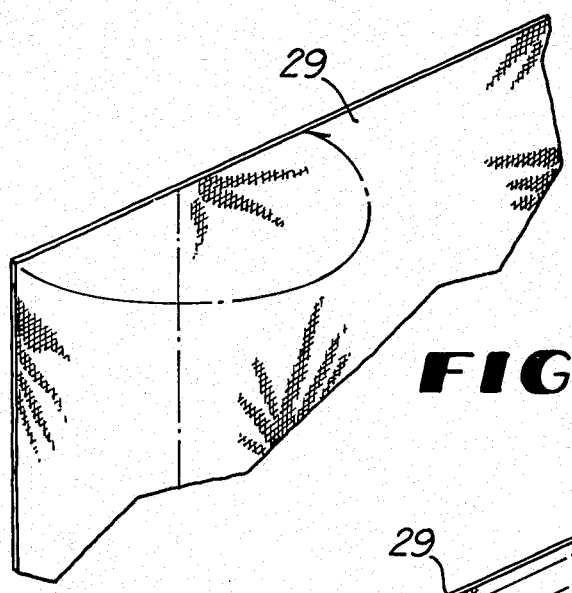
FIGS. 6 through 8 are perspective views of the waistband of the present invention in the area near the side seam of the garment of FIG. 1, showing sequential steps of attaching the fabric web to the elastic band.
Figure 7:
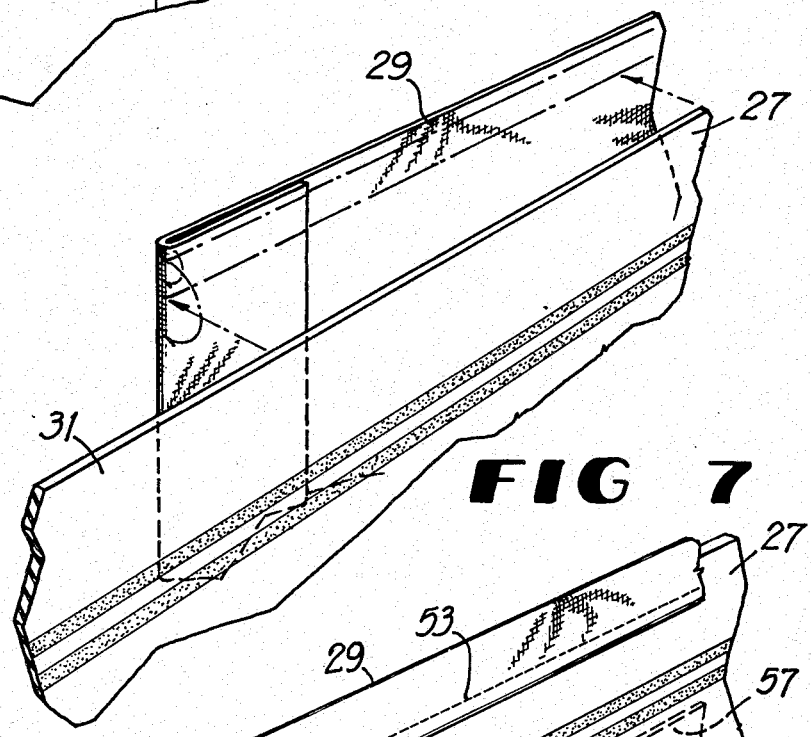
Figure 8:
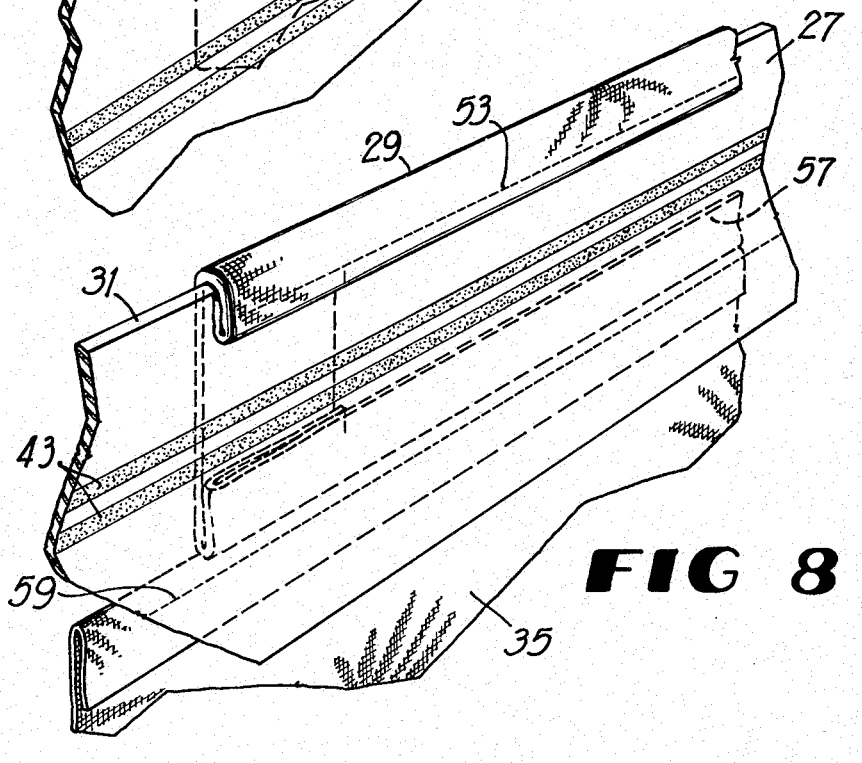

FIG. 3 is an inside elevational view of the left section of elastic band 27, showing portions of left rear fabric web segment 47 and left front fabric web segment 49. These segments of fabric web 29 are secured to elastic band 27 by securing means which are typically lines of stitching, but which may also be other means of binding or attaching fabric parts to each other such as an appropriate adhesive. In the depicted embodiment as seen in FIG. 3 and also in FIGS. 6 through 8, an edge of a segment of fabric web 29, here left front web segment 49, which will abut non-web area 31 of elastic band 27, is tucked under; likewise, the top linear edge 51 of left front web segment 49 is tucked under. The top linear edge 51 of left front web segment 49 is then attached to the upper inside surface of elastic band 27 by first line of stitching 53; alternatively before it is tucked under, it may first be attached to the inside surface of elastic band 27 and then folded over the top toward the outside of elastic band 27 and topstitched to elastic band 27.

The bottom linear edge 57 of left front web segment 49 is then tucked under and attached to the outside surface of the elastic band 27 by second line of stitching 59. This edge of left front web segment 49 may be attached at any height on the outside surface of the elastic band 27, as determined by the desired width of the fabric web 29, which finishes the appearance of the upper portion of garment 23, and by the proportion of elastic band 27 which is desired to be constrained from elongation by fabric web 29. The edge of left front web segment 49 abutting non-web area 31 of elastic band 27 is then attached to elastic band 27 by third line of stitching 61, which in the depicted embodiment is the only line of stitching outwardly visible in waistband 21.

Figure 5:
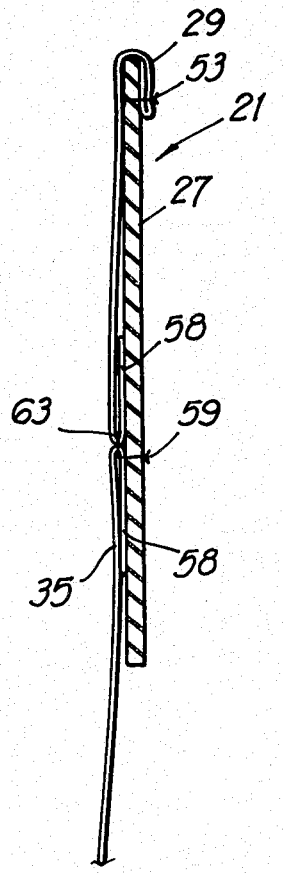
FIG. 5 is an elevational cross-section view of the waistband of the present invention illustrating the arrangement of the fabric web in relation to the elastic band, and taken along 5—5 of FIG. 3.

Prior to the step of attaching the bottom linear edge 57 of left front web segment 49 to the outer surface of elastic band 27, left front web segment 49 may be attached by fourth line of stitching 63 to the upper edge of garment body 35. In the depicted embodiment, this is accomplished by stitching the outer face of the upper edge of garment body 35 to the bottom linear edge 57 of left front web segment 49. The free edges 58 of left front web segment 49 and the garment body 35 extending beyond the fourth line of stitching 63 are then tucked under, and the second line of stitching 59 penetrates, and is coincident with, fourth line of stitching 63, to attach the fabric web 29 and the garment body 35 to elastic band 27 as shown in FIG. 5. If pockets 40 are employed, they may first be attached to garment body 35 and penetrated by second and fourth lines of stitching 59 and 63.

Figure 4:
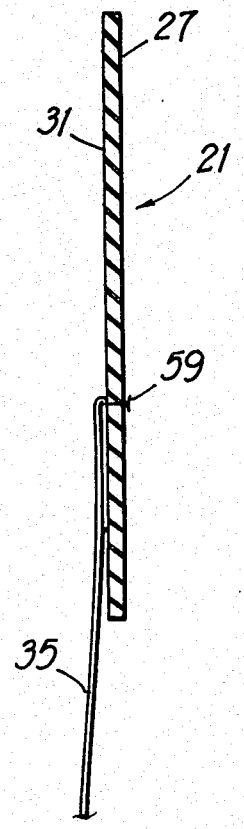
FIG. 4 is an elevational cross-section view of the waistband of the present invention near a side seam of the garment, taken along 4—4 of FIG. 3.

In the same manner as described for left front web segment 49, the remaining segments of fabric web 29 may be similarly attached to elastic band 27 and garment 23. The upper edge of garment body 35 which abuts non-web area 31 of elastic band 27 is attached, during the above described process, to elastic band 27 by second line of stitching 59. As shown in FIG. 4, second line of stitching 59 is the only line of stitching penetrating non-web area 31 of elastic band 27; it and the upper edge of garment body 35 can serve to partially restrain elastic band 27 from elongation in this area, although such restraint is less than that in areas of the elastic band 27 covered by fabric web 29 and penetrated by first line of stitching 53. Garment body 35 may also be puckered or gathered where it abuts non-web area 31 to permit even more extensibility of waistband 21 in this area.

FIG. 3 also illustrates the elongation properties of waistband 21 of the present invention. The regions of waistband 21 which comprise the portions of the upper portion of elastic band 27 attached to segments of fabric web 29 offer relatively great resistance to elongation and rolling. The lower regions of waistband 21 which are not covered by or attached to fabric web 29, act as a skirt to conform to the body of the wearer and provide a snug fit. The upper areas of waistband 21 near the sides of the wearer which comprise non-web area 31 of elastic band 27, offer lesser resistance to elongation than the portions of waistband 21 covered by fabric web 29. These non-web areas 31 allow waistband 21 to stretch more easily at the sides of the wearer, providing a snug fit of garment 23 with greater comfort, and more latitude for weight gain or loss, than in waistbands of earlier inventions.

FIG. 4 is a cross-sectional view of non-web area 31 of waistband 21 of the present invention near the side seam of garment 23, illustrating the arrangement of elastic band 27, garment body 35 and second line of stitching 59.

FIG. 5 is a cross-sectional view of a part of waistband 21 of the present invention which is attached to fabric web 29, illustrating the relationship among various parts. Fabric web 29 can be seen tucked and attached to elastic band 27 by means of first line of stitching 53. Fourth line of stitching 63 binds garment body 35 and fabric web 29 to each other, and second line of stitching 59 attaches them to the outer surface of elastic band 27.

Garment 23 as shown in FIG. 1 employs a custom outlet 67 at the seat seam 37. Other conventional outlets 67 may also be employed; alternatively, as mentioned above, elastic band 27 may extend through this area and be of continuous form, rather than comprising a left and a right elastic band member.

The foregoing description of the present invention is for purposes of explanation and illustration. It will be apparent to those skilled in the relevant art that modifications and changes may be made to the invention as thus described without departing from its scope and spirit.

I claim:

1. A garment waistband structure comprising:

(a) an elastic band comprising a left section and a right section;

(b) a four-segment fabric web partially covering the elastic band such that an area of the outside surface of the elastic band near each side seam of the garment remains exposed, comprising, for each section of the elastic band:

(i) a rear segment extending from the outlet near the seat seam of the garment to the exposed area of the elastic band; and (ii) a front segment extending from the exposed area of the elastic band to the fly of the garment;

(c) a first securing means which attaches the upper linear edge of each fabric web segment to the upper inside surface of the elastic band; and (d) a second securing means which attaches the lower linear edge of each fabric web segment to the outside surface of the elastic band.

2. A garment waistband structure according to claim 1 wherein said left section and said right section of said elastic band are portions of a single continuous elastic band member.

3. A garment waistband structure according to claim 1 wherein said left and right section of said elastic band comprise separate elastic band members.

4. A garment waistband structure according to claim 1 wherein said first securing means comprises a first line of stitching and said second securing means comprises a second line of stitching.

5. A garment waistband structure according to claim 1 wherein said fabric web is partially extensible.

6. A garment waistband structure according to claim 1 wherein the edges of said fabric web segments abutting said exposed areas of said elastic band are attached to the elastic band by a third securing means.

7. A garment waistband structure comprising:

(a) an elastic band comprising a left elastic band member and a right elastic band member;

(b) a four-segment partially extensible fabric web partially covering the elastic band such that an area of the outside surface of the elastic band near each side seam of the garment remains exposed, comprising for each elastic band member:

(i) a rear segment extending from the outlet near the seat seam of the garment to the exposed area of the elastic band; and (ii) a front segment extending from the exposed area of the elastic band to the fly of the garment;

(c) a first line of stitching which attaches the upper linear edge of each fabric web segment to the upper inside surface of the elastic band;

(d) a second line of stitching which attaches the lower linear edge of each fabric web segment to the outside surface of the elastic band; and (e) a third line of stitching which attaches the edges of the fabric web adjacent to the exposed areas of the elastic band to the elastic band.

8. A garment comprising:

I. a garment waistband structure comprising:

(a) an elastic band comprising a left elastic band member and a right elastic band member;

(b) a four-segment fabric web partially covering the elastic band such that an area of the outside surface of the elastic band near each side seam of the garment remains exposed, comprising for each elastic band member:

(i) a rear segment extending from the outlet near the seat seam of the garment to the exposed area of the elastic band; and (ii) a front segment extending from the exposed area of the elastic band to the fly of the garment;

(c) a first securing means which attaches the upper linear edge of each fabric web segment to the upper inside surface of the elastic band;

(d) a second securing means which attaches the lower linear edge of each fabric web segment to the outside surface of the elastic band; and (e) a third securing means which attaches the edges of the fabric web adjacent to the exposed areas of the elastic band to the elastic band; and II. a garment body attached proximate the upper linear edge thereof by a fourth securing means to the bottom linear edge of the fabric web.

9. A garment according to claim 8 wherein said securing means comprise lines of stitching.

10. A garment according to claim 9 wherein said fabric web is partially extensible.

11. Trousers comprising:

I. a waistband structure, comprising:

(a) an elastic band comprising a left elastic band member and a right elastic band member;

(b) a four-segment partially extensible fabric web partially covering the band such that an area of the outside surface of the elastic band near each side seam of the trousers remains exposed, comprising for each elastic band member:

(i) a rear segment extending from the outlet near the seat seam of the trousers to the exposed area of the elastic band; and (ii) a front segment extending from the exposed area of the elastic band to the fly of the trousers;

(c) a first line of stitching which attaches the upper linear edge of each fabric web segment to the upper inside surface of the elastic band;

(d) a second line of stitching which attaches the lower linear edge of each fabric web segment to the outside surface of the elastic band; and (e) an third line of stitching which attaches the edges of the fabric web adjacent to the exposed areas of the elastic band to the elastic band; and II. a trousers body with inset pockets which body is attached proximate the upper linear edge thereof by a fourth line of stitching to the bottom linear edge of the fabric web.

* * * * *